US012774549B2

(12) United States Patent
Kim et al.

(10) Patent No.: US 12,774,549 B2
(45) Date of Patent: Oct. 27, 2026

(54) CLOTHING TREATMENT APPARATUS AND DAMPER FOR WASHING MACHINE

(71) Applicants: SAMSUNG ELECTRONICS CO., LTD., Suwon-si (KR); INHA UNIVERSITY RESEARCH AND BUSINESS FOUNDATION, Michuhol-gu (KR)

(72) Inventors: Doyeon Kim, Suwon-si (KR); Seungbok Choi, Incheon (KR); Junhyeong Park, Suwon-si (KR); Byunghyuk Kang, Incheon (KR); Jeonghoon Kang, Suwon-si (KR); Bogyu Kim, Pohang-si (KR); Yujin Park, Incheon (KR); Jaeik Park, Suwon-si (KR); Sejun Lee, Suwon-si (KR); Hyungjin Choe, Suwon-si (KR)

(73) Assignees: SAMSUNG ELECTRONICS CO., LTD., Suwon-si (KR); INHA UNIVERSITY RESEARCH AND BUSINESS FOUNDATION, Michuhol-gu (KR)

( * ) Notice: Subject to any disclaimer, the term of this patent is extended or adjusted under 35 U.S.C. 154(b) by 141 days.

(21) Appl. No.: 18/955,330

(22) Filed: Nov. 21, 2024

(65) Prior Publication Data

US 2025/0084580 A1 Mar. 13, 2025

Related U.S. Application Data

(63) Continuation of application No. PCT/KR2023/007195, filed on May 25, 2023.

(30) Foreign Application Priority Data

Jul. 13, 2022 (KR) ..... 10-2022-0086557

(51) Int. Cl.
*D06F 37/22* (2006.01)
*D06F 23/02* (2006.01)

(52) U.S. Cl.
CPC ..... *D06F 37/22* (2013.01); *D06F 23/02* (2013.01)

(58) Field of Classification Search
None
See application file for complete search history.

(56) References Cited

U.S. PATENT DOCUMENTS 6,151,930 A 11/2000 Carlson
6,481,546 B2 * 11/2002 Oliver ..... F16F 9/537 188/269

(Continued)

FOREIGN PATENT DOCUMENTS

CN 106917219 B 6/2020
CN 113511348 B 10/2022

(Continued)

OTHER PUBLICATIONS

Search notes related to Google Scholar search (Year: 2026).*

(Continued)

*Primary Examiner* — Rita P Adhlakha
(74) *Attorney, Agent, or Firm* — STAAS & HALSEY LLP

(57) ABSTRACT

A clothing treatment apparatus including a cabinet, a tub to be disposed within the cabinet, and a damper configured to support the tub while the tub is disposed within the cabinet, a damper includes a housing, a piston configured to be movable within the housing, a core to be disposed within the (Continued)

housing and including a yoke and teeth extending from the yoke toward the piston, a coil wound on the core, and a magnetorheological elastomer to be disposed between the piston and the core whereby while the magnetorheological elastomer is between the piston and the core, stiffness of the magnetorheological elastomer is changeable by a magnetic field applied to control a movement of the piston within the housing.

15 Claims, 12 Drawing Sheets

(56) References Cited

U.S. PATENT DOCUMENTS

| | | | |
|---|---|---|---|
| 9,004,243 | B2 | 4/2015 | Nehl et al. |
| 10,316,450 | B2 | 6/2019 | Wu et al. |
| 10,400,841 | B2 | 9/2019 | Inoue et al. |
| 2015/0247548 | A1 | 9/2015 | Battlogg et al. |

FOREIGN PATENT DOCUMENTS

| | | |
|---|---|---|
| KR | 20-0459493 | 4/2012 |
| KR | 10-2013-0002114 | 1/2013 |
| KR | 10-2013-0010798 | 1/2013 |
| KR | 10-2014-0030262 | 3/2014 |
| KR | 10-1375695 | 3/2014 |
| KR | 10-1757434 | 7/2017 |
| KR | 10-1757435 | 7/2017 |
| KR | 10-2018-0114610 | 10/2018 |
| KR | 10-2018-0121719 | 11/2018 |
| KR | 10-2098882 | 4/2020 |
| KR | 10-2020-0076427 | 6/2020 |
| KR | 10-2021-0087820 | 7/2021 |

OTHER PUBLICATIONS

International Search Report dated Sep. 25, 2023 issued in U.S. Appl. No. PCT/KR2023/007195.

Written Opinion dated Sep. 25, 2023 issued in U.S. Appl. No. PCT/KR2023/007195.

* cited by examiner

CLOTHING TREATMENT APPARATUS AND DAMPER FOR WASHING MACHINE

CROSS-REFERENCE TO RELATED APPLICATION

This application is a continuation application, under 35 U.S.C. § 111(a), of international application No. PCT/KR2023/007195, filed May 25, 2023, which claims priority under 35 U. S. C. § 119 to Korean Patent Application No. 10-2022-0086557, filed Jul. 13, 2022, the disclosures of which are incorporated herein by reference in their entireties.

TECHNICAL FIELD

The disclosure relates to a clothing treatment apparatus and a damper for washing machine, and more particularly, to a clothing treatment apparatus with an improved damper and an improved damper for a washing machine.

BACKGROUND ART

In general, clothing treatment apparatuses include washing machines that use a driving force of a motor to rotate laundry and detergent placed in a drum together to wash the laundry by mutual friction, and drying machines that rotate a drum receiving an object to be dried to dry the object in the rotation.

A washing machine, which is an example of a clothing treatment apparatus, may include a cabinet forming an exterior thereof, a tub for receiving washing water, and a drum for receiving laundry and rotatably provided in the tub. The washing machine may also include a damper for supporting the tub and dampening vibrations and shaking generated by the tub.

Recently, dampers including a magnetorheological elastomer have been used. The magnetorheological elastomer may change its stiffness in response to a magnetic field, thereby changing the frictional force of the damper to control the damping force. For example, the damping force may be increased in a low-speed vibration section and decreased in a high-speed vibration section.

DISCLOSURE

Technical Problem

An aspect of the present disclosure provides a clothing treatment apparatus and a damper for a washing machine with improved vibration reduction effectiveness.

Further, an aspect of the present disclosure provides a clothing treatment apparatus and a damper for a washing machine capable of reducing manufacturing costs.

Further, an aspect of the present disclosure provides a clothing treatment apparatus and a damper for a washing machine capable of efficiently utilizing space.

Further, an aspect of the present disclosure provides a clothing treatment apparatus and a damper for a washing machine with improved durability.

Technical Solution

According to an embodiment of the present disclosure, a clothing treatment apparatus includes a cabinet, a tub to be disposed within the cabinet, and a damper configured to support the tub while the tub is disposed within the cabinet;

wherein the damper includes a housing, a piston configured to be movable within the housing, a core to be disposed within the housing and including a yoke and teeth extending from the yoke toward the piston, a coil wound on the core, and a magnetorheological elastomer to be disposed between the piston and the core whereby while the magnetorheological elastomer is between the piston and the core, stiffness of the magnetorheological elastomer is changeable by a magnetic field applied to control a movement of the piston within the housing.

The teeth may extend in a direction different from a direction in which the piston moves.

The teeth may extend in a direction perpendicular to a direction in which the piston moves.

The coil may be wound on the teeth in a direction perpendicular to a direction in which the piston moves.

The yoke may have an annular shape, and the teeth may be disposed radially between the yoke and the piston.

The teeth may be first teeth and the core includes second teeth spaced apart from the first teeth along a circumferential direction of the yoke.

The coil may be a first coil wound on the first teeth, and the damper may comprise a second coil wound on the second teeth and spaced apart from the first coil along the circumferential direction of the yoke.

The magnetorheological elastomer may include a cylindrical portion coupled to the piston, and an insertion portion protruding from the cylindrical portion toward the housing and disposed between the first teeth and the second teeth.

The second teeth may be arranged at a height that is same as a height of the first teeth.

The teeth may include a winding portion on which the coil is wound, and a guide portion disposed at one end of the winding portion facing the magnetorheological elastomer and having a plate shape.

The guide portion may be formed to be curved corresponding to the circumference of the magnetorheological elastomer.

The clothing treatment apparatus may further include a friction member disposed between the piston and the magnetorheological elastomer.

The friction member may include polyurethane.

The housing may include an upper cap configured to cover an upper portion of the core, a lower cap configured to cover a lower portion of the core, and a guide ring disposed between the upper cap and the lower cap and surrounding the core.

The stiffness of the magnetorheological elastomer may increase based on formation of a magnetic field.

According to an embodiment of the present disclosure, a damper for a washing machine includes a housing, a piston configured to be movable within the housing, a core to be disposed within the housing and including a yoke having an annular shape and teeth to be radially disposed between the yoke and the piston, a coil wound on the teeth, the coil wound about a direction different from a direction in which the piston moves, and a magnetorheological elastomer to be disposed between the piston and the core and increasing stiffness in response to the formation of a magnetic field.

The coil may be wound about a direction perpendicular to a direction in which the piston moves.

The teeth include first teeth, and second teeth spaced apart from the first teeth along a circumferential direction of the yoke and arranged at the same height as the first teeth.

The teeth may include a winding portion on which the coil is wound, and a guide portion disposed at one end of the winding portion facing the magnetorheological elastomer and having a plate shape.

The damper for washing machine may further include a friction member disposed between the piston and the magnetorheological elastomer.

Advantageous Effects

According to various embodiments of the present disclosure, the clothing treatment apparatus and damper for washing machine may include the magnetorheological elastomer to improve vibration reduction effectiveness.

According to various embodiments of the present disclosure, the clothing treatment apparatus and damper for washing machine may apply a magnetic field over the entire area of the magnetorheological elastomer, thereby reducing manufacturing costs.

According to various embodiments of the present disclosure, the clothing treatment apparatus and damper for washing machine may apply a magnetic field over the entire area of the magnetorheological elastomer, thus effectively utilizing space.

According to the present disclosure, the clothing treatment apparatus and damper for washing machine may include a friction member, thereby improving durability.

MODES OF THE INVENTION

Figure 1:
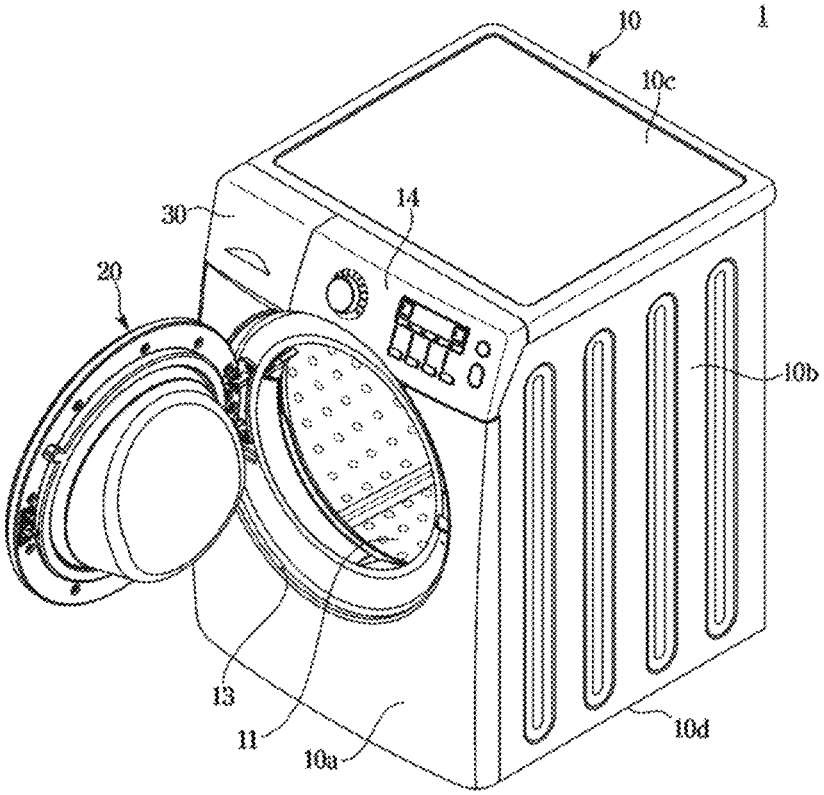
FIG. 1 is a perspective view showing a clothing treatment apparatus according to an embodiment of the present disclosure.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each element.

Hereinafter, various embodiments according to the disclosure will be described in detail with reference to the accompanying drawings.

Figure 2:
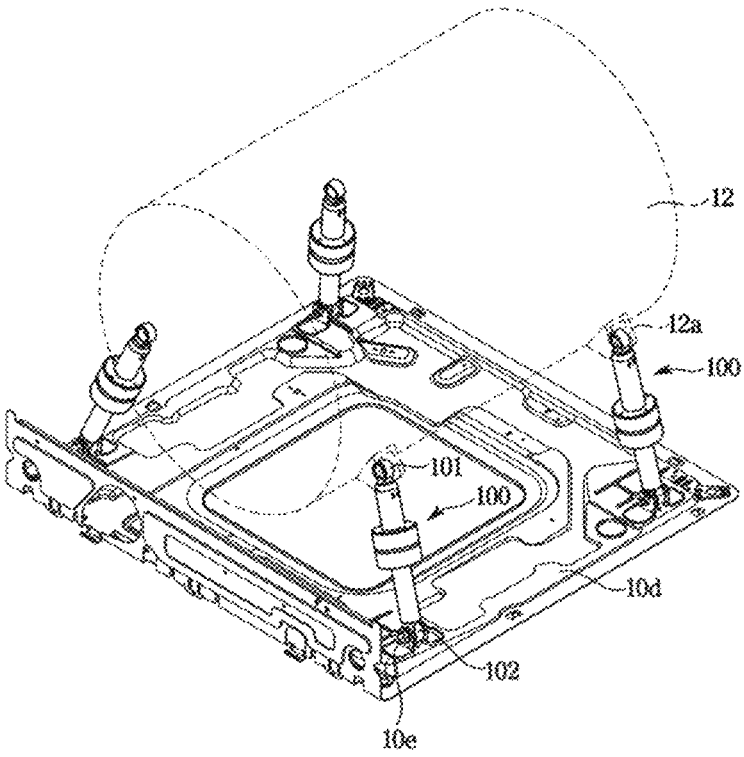
FIG. 2 is a perspective view of some configurations of the clothing treatment apparatus shown in FIG. 1 according to an embodiment of the present disclosure.

FIG. 1 is a perspective view showing a clothing treatment apparatus according to an embodiment of the present disclosure. FIG. 2 is a perspective view illustrating some configurations of the clothing treatment apparatus shown in FIG. 1.

Hereinafter, for easy of description, a damper according to the embodiment of the present disclosure is described as being applied to a washing machine, which is an example of a clothing treatment apparatus, but the damper according to the embodiment of the present disclosure may be applied to various clothing treatment apparatuses including a damper for reducing vibration of a tub and/or drum, such as a dryer or the like.

Referring to FIG. 1 and FIG. 2, a washing machine 1 includes a cabinet 10 forming an exterior thereof, a tub 12 installed in an inside of the cabinet 10 and storing washing water, and a drum 11 having a cylindrical shape and rotatably installed in the inside of the tub 12 and having a plurality of through holes formed in its wall surface.

The cabinet 10 may be provided in an approximately hexahedral shape. The cabinet 10 may include a front surface 10*a*, a rear surface (not shown), two side surfaces 10*b*, an upper surface 10*c*, and a lower surface 10*d* forming a bottom. The front surface 10*a* of the cabinet 10 may be a front panel 10*a*.

An opening 13 may be formed in the front surface 10*a* of the cabinet 10 to allow laundry to be put in or taken out. Openings may also be formed in the tub 12 and the drum 11 to allow laundry to be put in or taken out toward the front surface of the cabinet 10, and the openings of the tub 12 and the drum 11 may be positioned to correspond to the opening 13 of the front surface 10*a*.

The opening 13 of the cabinet 10 may be provided with a door 20 for opening and closing the openings of the tub 12 and the drum 11.

A control panel 14 for controlling an operation of the washing machine 1 may be provided on an upper portion of the front surface 10*a* of the cabinet 10. The control panel 14 may be a configuration included in the front panel 10*a*.

A drive unit (not shown) may be provided on a rear side of the drum 11. The drive unit may be configured to rotate the drum 11, and may be configured to transmit a drive force generated by the motor to a rotation shaft to rotate the drum 11.

A water supply valve (not shown) and water supply pipes for controlling the water supply may be provided on the tub 12. In addition, a detergent supply device 30 for supplying detergent to the inside of the tub 12 during the water supply process may be installed above the tub 12.

A drainage device (not shown) including a drain pipe (not shown), a drain valve (not shown), and the like for draining water inside the tub 12 may be installed below the tub 12.

According to an embodiment of the present disclosure, the front surface 10*a*, the rear surface (not shown), both side surfaces 10*b*, the upper surface 10*c*, and the lower surface 10*d* forming the cabinet 10 may be separately provided and assembled, but the present disclosure is not limited thereto. For example, at least a portion of the front surface 10*a*, the rear surface (not shown), both side surfaces 10*d*, the upper surface 10*c*, and the lower surface 10*d* of the cabinet may be formed integrally.

The tub 12 may be elastically supported from the cabinet 10 by springs (not shown) provided above and vibration reducing devices 100 provided below. The vibration reducing devices 100 may be referred to as dampers 100. For example, the springs and dampers 100 may absorb vibration energy between the tub 12 and the cabinet 10 when vibrations generated by rotation of the drum 11 are transmitted to the tub 12 and the cabinet 10, thereby attenuating the vibrations transmitted to the cabinet 10.

The damper 100 supporting a lower portion of the tub 12 may be provided in a plurality. For example, the number of dampers 100 supporting the tub 12 may be four. The plurality of dampers 100 may be configured to reduce vibrations or shaking transmitted from the tub 12 to the cabinet 10 during the washing, rinsing, or spin-drying process.

The damper 100 may include a first fixing portion 101 formed on an upper end of the damper and a second fixing portion 102 formed on a lower end thereof. The outer surface of the tub 12 may be provided with a damper coupling portion 12*a* that may be coupled to the upper ends of the dampers 100. The first fixing portion 101 of the damper 100 may be supported on the damper fixing portion 12*a* of the tub 12. The damper fixing portion 12*a* of the tub 12 may be provided to correspond to the first fixing portion 101 of the damper 100. The second fixing portion 102 of the damper 100 may be supported on a damper fixing portion 10*e* formed on the lower surface 10*d*.

In the drawings, the first fixing portion 101 is shown as being disposed at the upper end of the damper 100 and the second fixing portion 102 is shown as being disposed at the lower end of the damper 100, but the present disclosure is not limited thereto. For example, the first fixing portion 101 may be disposed at the lower end of the damper 100 and the second fixing portion 102 may be disposed at the upper end of the damper 100.

Figure 3:
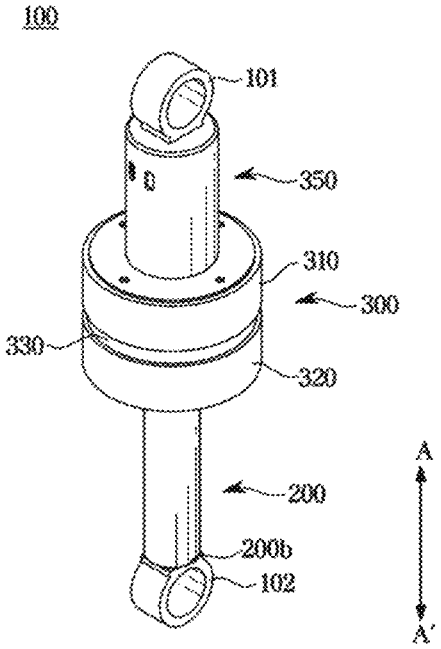
FIG. 3 is a perspective view showing a damper of the clothing treatment apparatus shown in FIG. 1 according to an embodiment of the present disclosure.
Figure 4:
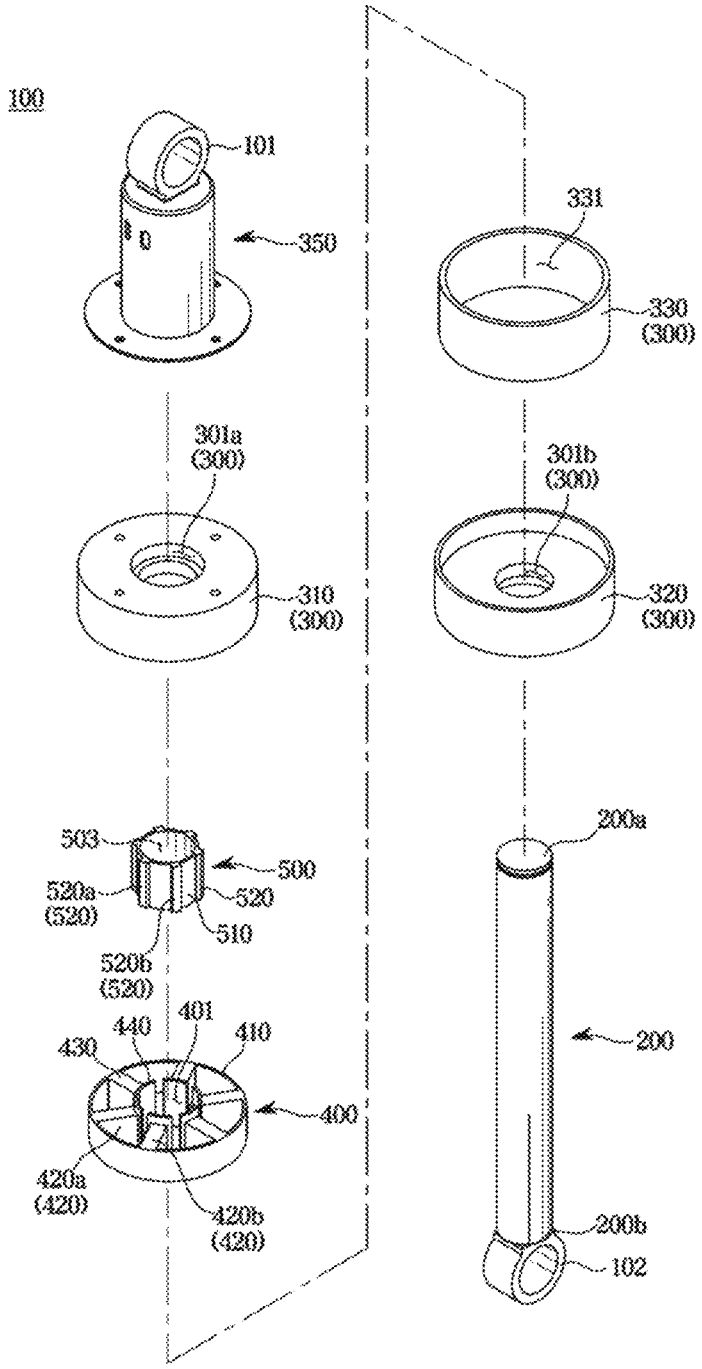
FIG. 4 is an exploded perspective view of the damper shown in FIG. 3 according to an embodiment of the present disclosure.
Figure 5:
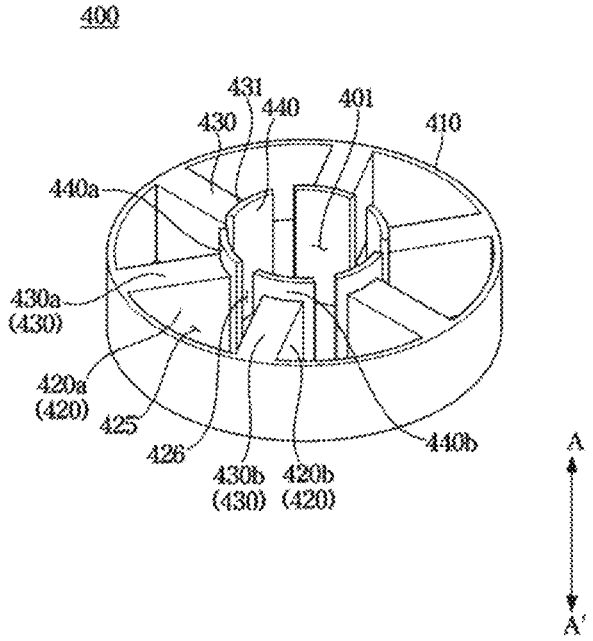
FIG. 5 is a perspective view of a core of the damper shown in FIG. 4 according to an embodiment of the present disclosure.
Figure 6:
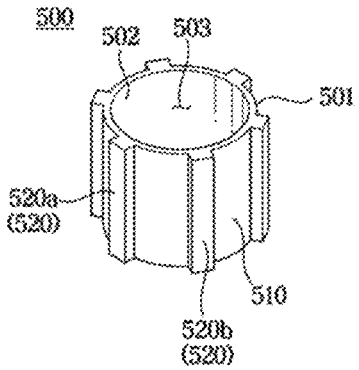
FIG. 6 is a perspective view of a magnetorheological elastomer of the damper shown in FIG. 4 according to an embodiment of the present disclosure.

FIG. 3 is a perspective view of the damper of the clothing treatment apparatus shown in FIG. 1. FIG. 4 is an exploded perspective view of the damper shown in FIG. 3. FIG. 5 is a perspective view of a core of the damper shown in FIG. 4. FIG. 6 is a perspective view of a magnetorheological elastomer of the damper shown in FIG. 4.

The damper 100 may include a piston 200. The piston 200 may have an approximately cylindrical shape.

The piston 200 may be arranged to be movable within a housing 300. The piston 200 may be arranged to be linearly movable within the housing 300. In this case, friction between the piston 200 and the housing 300 may dampen vibrations transmitted from the tub 12 to the cabinet 10. In particular, vibrations transmitted from the tub 12 to the cabinet 10 may be dampened by the friction between the piston 200 and a magnetorheological elastomer 500. This will be described later.

The piston 200 may be extended between the tub 12 and the cabinet 10. A first end 200*a* of the piston 200 may be disposed inside the housing 300, and a second end 200*b* of the piston 200 may be disposed outside the housing 300.

The second fixing portion 102 may be disposed on the second end 200*b* of the piston 200. The second fixing portion 102 may be fixed to the lower surface 10*d*. However, the present disclosure is not limited to the second fixing portion 102, and the second fixing portion 102 may also be fixed to the tub 12.

Referring to FIG. 4, the damper 100 may include the housing 300. The housing 300 may be configured to accommodate the piston 200. The housing 300 may be arranged such that the piston 200 may be linearly movable therein. The piston 200 may be movably inserted into a through hole 301 of the housing 300. The housing 300 may accommodate a core 400 and the magnetorheological elastomer 500.

The housing 300 may have an approximately cylindrical shape. The housing 300 may include the through hole 301 into which the piston 200 may be inserted.

The housing 300 may include an upper cap 310 and a lower cap 320. The upper cap 310 may be disposed on an upper portion of the housing 300 to cover an upper portion of the core 400. The lower cap 320 may be disposed on a lower portion of the housing 300 to cover a lower portion of the core 400.

The upper cap 310 may include an upper through hole 301*a* into which the piston 200 is movably inserted. The lower cap 320 may include a lower through hole 301*b* into which the piston 200 is movably inserted.

A guide ring 330 may be disposed between the upper cap 310 and the lower cap 320. The guide ring 330 may be coupled to the upper cap 310 and the lower cap 320. The core 400 and the magnetorheological elastomer 500 may be accommodated in an inner space 331 of the guide ring 330.

The guide ring 330 may support the piston 200 in response to the piston 200 being in approximately linear motion. The guide ring 330 may support the core 400.

The damper 100 may include an upper case 350. The upper case 350 may be arranged on an upper side of the housing 300. The upper case 350 may be arranged on one side of the housing 300 facing the tub 12. The upper case 350 may be coupled to the housing 300. The upper case 350 may be coupled to the upper cap 310. The first fixing portion 101 may be formed at one end of the upper case 350. The upper case 350 may accommodate a portion of the piston 200 therein.

The damper 100 may include the core 400. The core 400 may be disposed within the housing 300. The upper portion of the core 400 may be covered by the upper cap 310, and the lower portion of the core 400 may be covered by the lower cap 320.

The core 400 may be accommodated in the inner space 331 of the guide ring 330. The core 400 may be supported by the guide ring 330. A side of the core 400 may be in contact with the guide ring 330.

The core 400 may be arranged to surround the piston 200. The core 400 may be arranged to surround the magnetorheological elastomer 500. The core 400 may include a core hole 401 formed approximately at the center. The magnetorheological elastomer 500 may be inserted into the core hole 401. The piston 200 may penetrate the core hole 401.

Referring to FIG. 5, the core 400 may include a yoke 410 and teeth 420. A coil 450 may be wound on the teeth 420. The coil 450 may be supplied with current from an external power source to form a magnetic field. The yoke 410 may increase the strength of the magnetic field formed by the coils. The core 400 may include a magnetic material.

The yoke 410 may have an approximately annular shape. The yoke 410 may be disposed on an outer circumference of the core 400. The yoke 410 may be in contact with the guide ring 330.

The teeth 420 may extend from the yoke 410 toward the piston 200. The teeth 420 may be radially disposed between the yoke 410 and the piston 200. The teeth 420 may extend toward the core hole 401 formed at the center of the core 400.

Based on a direction in which the piston 200 moves within the housing 300 being referred to as a first direction A-A', the teeth 420 may extend in a second direction different from the first direction A-A'. The second direction may be perpendicular to the first direction A-A'.

Alternatively, based on the direction in which the piston 200 extends being referred to as the first direction A-A', the teeth 420 may extend in a second direction different from the first direction A-A'. The second direction may be perpendicular to the first direction A-A'.

The teeth 420 may include a winding portion 430 and a guide portion 440. The coil 450 may be wound on the winding portion 430. The winding portion 430 may extend from the yoke 410. The winding portion 430 may extend in the second direction different from the first direction A-A' in which the piston 200 extends.

The guide portion 440 may be disposed at one end 431 of the winding portion 430 facing the magnetorheological elastomer 500. The guide portion 440 may be configured such that when a magnetic field is formed as current flows through the coil 450, the magnetic field may be applied to the magnetorheological elastomer 500. The guide portion 440 may be configured to ensure that the magnetic field is applied uniformly to the magnetorheological elastomer 500.

The guide portion 440 may be provided in an approximately plate shape. The guide portion 440 may be formed to be curved corresponding to the circumference of the magnetorheological elastomer 500. The guide portion 440 may have a curved surface.

The cross-sectional area of the guide portion 440 along the first direction A-A' may be arranged to be larger than the cross-sectional area of the winding portion 430. The area of the surface of the guide portion 440 facing the piston 200 may be arranged to be larger than the area of the surface of the winding portion 430 facing the piston 200.

A length of the guide portion 440 along the first direction A-A' may be arranged to be larger than the length of the winding portion 430 along the first direction A-A'. A length of the guide portion 440 extending along the circumference of the piston 200 may be arranged to be greater than the length of the winding portion 430 extending along the circumference of the piston 200.

The teeth 420 may include first teeth 420*a* and second teeth 420*b*. The second teeth 420*b* may be arranged to be spaced apart from the first teeth 420*a* along a circumferential direction of the yoke 410. The first teeth 420*a* and the second teeth 420*b* may be spaced apart at regular intervals.

A spacing space 425 may be formed between the first teeth 420*a* and the second teeth 420*b*. A guide portion spacing space 426 may be formed between a guide portion 440*a* of the first teeth 420*a* and a guide portion 440*b* of the second teeth 420*b*.

The first teeth 420*a* and the second teeth 420*b* may be arranged at the same height. The first teeth 420*a* and the second teeth 420*b* may be arranged in a single layer. An upper surface and/or lower surface of a first winding portion 430*a* of the first teeth 420*a* may be positioned on approximately the same plane as an upper surface and/or lower surface of a second winding portion 430*b* of the second teeth 420*b*.

Referring to FIG. 4, the damper 100 may include the magnetorheological elastomer 500. The magnetorheological elastomer 500 may be disposed within the housing 300. The magnetorheological elastomer 500 may be accommodated in the inner space 331 of the guide ring 330. The magnetorheological elastomer 500 may be disposed between the piston 200 and the core 400.

Referring to FIG. 5, the magnetorheological elastomer 500 may have an approximately cylindrical shape. A through hole 503 through which the piston 200 passes may be formed at an approximately center of the magnetorheological elastomer 500.

The magnetorheological elastomer 500 may cover a portion of the piston 200. An inner surface 502 of the magnetorheological elastomer 500 may be in contact with the piston 200. An outer surface 501 of the magnetorheological elastomer 500 may be in contact with the teeth 420 of the core 400.

The magnetorheological elastomer 500 may include a cylindrical portion 510 and an insertion portion 520. The cylindrical portion 510 may extend along the circumference of the piston 200. The cylindrical portion 510 may be coupled to the piston 200. The inner surface 502 of the cylindrical portion 510 may be in contact with the piston 200. The cylindrical portion 510 and the insertion portion 520 may be formed integrally.

The insertion portion 520 may protrude from the cylindrical portion 510 toward the housing 300. The insertion portion 520 may have a rib shape. The insertion portion 520 may include a first insertion portion 520*a* and a second insertion portion 520*b* arranged to be spaced apart from the first insertion portion 520*a* along a circumferential direction of the cylindrical portion 510.

The magnetorheological elastomer 500 may be a polymer or silicone-based rubber material containing micro-sized iron particles. The magnetorheological elastomer 500 may change a stiffness in response to an applied magnetic field, resulting in a change in surface friction coefficient.

Figure 7:
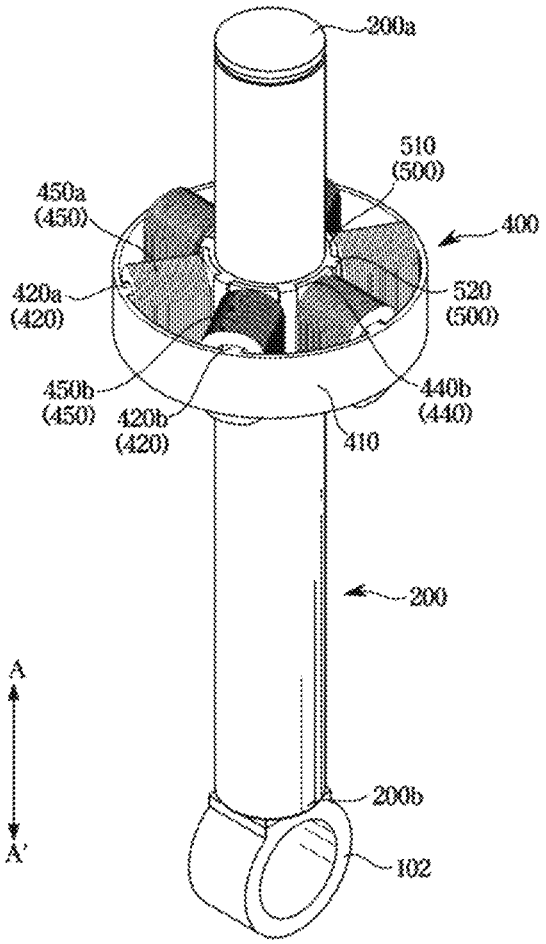
FIG. 7 is a perspective view of a damper of FIG. 4 with a piston, core, and magnetorheological elastomer coupled and a coil wound according to an embodiment of the present disclosure.
Figure 8:
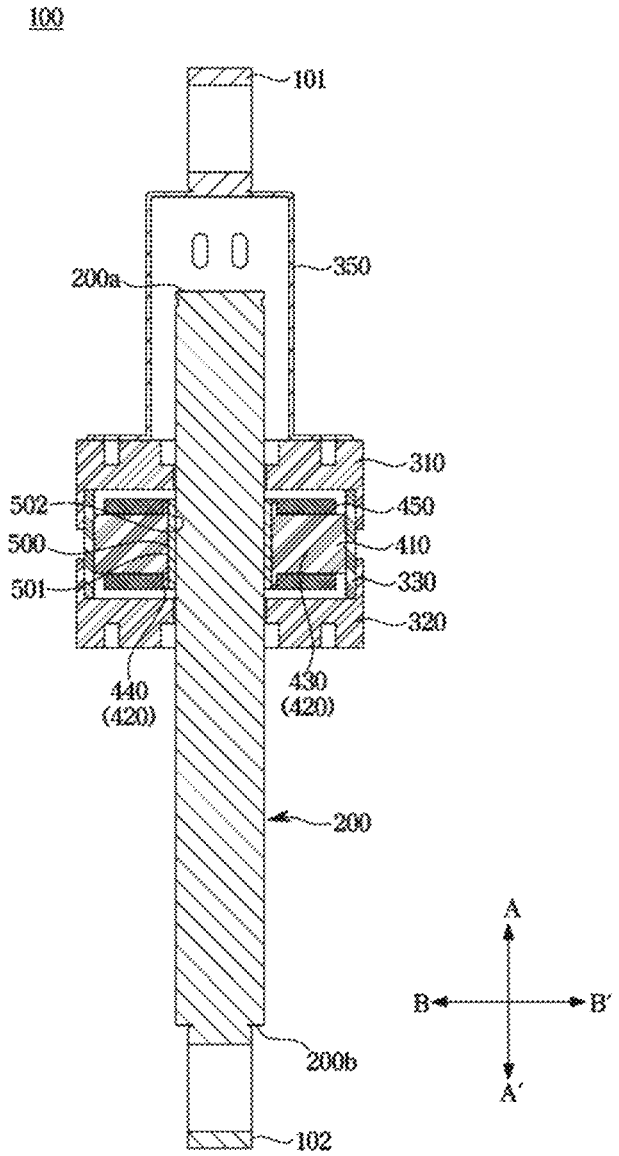
FIG. 8 is a transverse sectional view of the damper shown in FIG. 3 according to an embodiment of the present disclosure.
Figure 9:
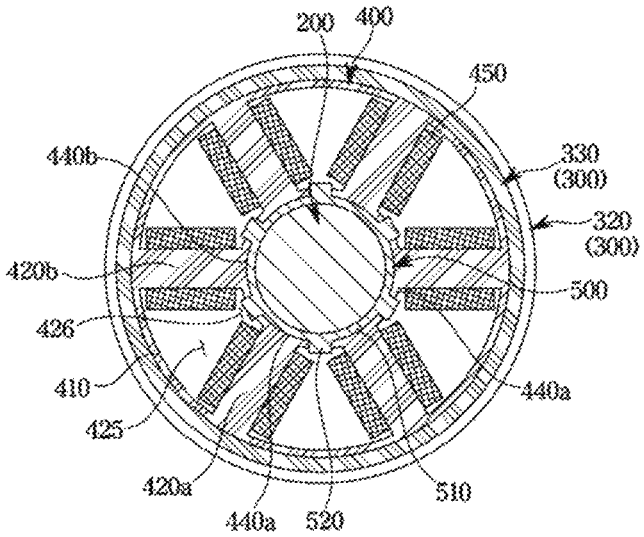
FIG. 9 is a longitudinal sectional view of the damper shown in FIG. 3 according to an embodiment of the present disclosure.

FIG. 7 is a perspective view of the damper shown in FIG. 4 with the piston, core, and magnetorheological elastomer coupled and the coil wound. FIG. 8 is a transverse cross-sectional view of the damper shown in FIG. 3. FIG. 9 is a longitudinal cross-sectional view of the damper shown in FIG. 3.

Referring to FIGS. 7 to 9, a magnetic field may be generated when current flows through the coil 450 wound on the teeth 420, and the magnetorheological elastomer 500 may change its stiffness in response to the magnetic field. For example, when the drum 11 rotates at a low speed, a current may be applied to the coil 450 to increase the stiffness of the magnetorheological elastomer 500. This may increase the normal drag force acting on the piston 200, thereby increasing the frictional force between the magnetorheological elastomer 500 and the piston 200 due to the up-and-down movement of the piston 200, thereby increasing the damping force of the damper 100. Conversely, when the drum 11 rotates at a high speed, a current may not be applied to the coil 450 to reduce the stiffness of the magnetorheological elastomer 500. This may reduce the normal drag force acting on the piston 200, thereby reducing the frictional force between the magnetorheological elastomer 500 and the piston 200 due to the up-and-down movement of the piston 200, thereby reducing the damping force of the damper 100.

To apply a magnetic field to the magnetorheological elastomer 500, the coil 450 may be wound on the teeth 420. A first coil 450*a* may be wound on the first teeth 420*a*, and a second coil 450*b* may be wound on the second teeth 420*b*. The second coil 450*b* may be arranged to be spaced apart from the first coil 450*a* along the circumferential direction of the yoke 410.

The coil 450 may be wound around the second direction that is different from the first direction A-A' in which the piston 200 extends. Referring to FIG. 8, the second direction B-B' may be perpendicular to the first direction A-A'.

When the coil is wound around the piston, the coil may be wound around the piston. In particular, the coil may be wound around a bobbin provided between the yokes, and be wound in a manner of wrapping around the circumference of the piston. In this case, the magnetic field is mainly generated between the yoke and the piston, and no magnetic field is formed or a small magnetic field is formed between the bobbin and the piston on which the coil is wound. Accordingly, in the region where the magnetic field is formed, the stiffness of the magnetorheological elastomer may change, but in the region where the magnetic field is not formed, the stiffness of the magnetorheological elastomer does not change, or the degree of change in the stiffness is relatively small, so the effect on the change of frictional force may be relatively small. This may result in inefficient use of the magnetorheological elastomer.

However, according to the present disclosure, the coil 450 may be wound around the direction B-B' perpendicular to the extension direction A-A' of the piston 200. In other words, the coil 450 may be wound around the direction B-B' perpendicular to the extension direction A-A' of the magnetorheological elastomer 500, such that a magnetic field may be applied to most of the region of the magnetorheological elastomer 500. Accordingly, the entire region of the magnetorheological elastomer 500 may change in stiffness, which may affect the change in frictional force. In other words, the entire region of the magnetorheological elastomer 500 may be effectively used to the change in the damping force of the damper 100, thereby reducing the cost burden of using an expensive magnetorheological elastomer 500, as well as realizing miniaturization of the damper 100.

Referring to FIG. 9, the magnetorheological elastomer 500 may be disposed on the inside of the core 400. In particular, the insertion portion 520 of the magnetorheological elastomer 500 may be disposed in the spacing space 425 between the first teeth 420*a* and the second teeth 420*b*, thereby allowing the magnetorheological elastomer 500 to be easily inserted into the core 400. In particular, the insertion portion 520 may be disposed in the guide portion spacing space 426 between the guide portion 440*a* of the first teeth 420*a* and the guide portion 440*b* of the second teeth 420*b*. In this case, the outer surface 501 of the cylindrical portion 510 of the magnetorheological elastomer 500 may be in contact with the guide portion 440 of the teeth 420.

Figure 10:
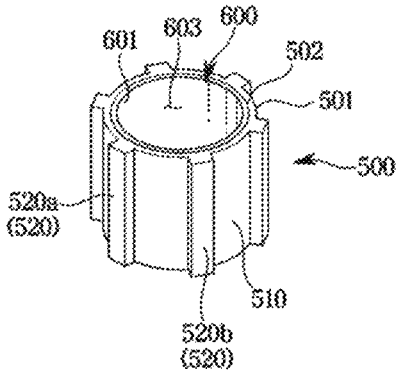
FIG. 10 is a perspective view of the magnetorheological elastomer of the damper of FIG. 6 with a friction member added thereto according to an embodiment of the present disclosure.
Figure 11:
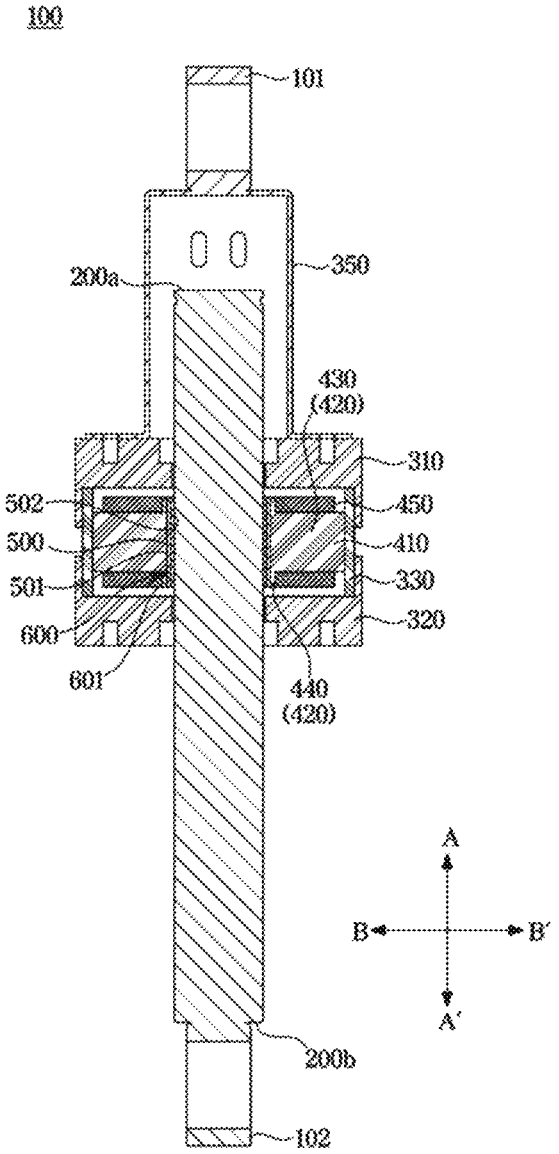
FIG. 11 is a transverse sectional view of the damper of FIG. 10 coupled with the magnetorheological elastomer of FIG. 10 according to an embodiment of the present disclosure.
Figure 12:
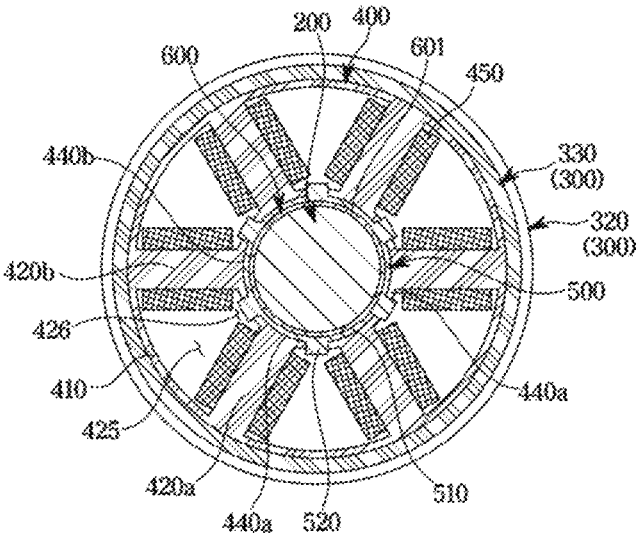
FIG. 12 is a longitudinal sectional view of the damper coupled with the magnetorheological elastomer of FIG. 10 according to an embodiment of the present disclosure.

FIG. 10 is a perspective view of the magnetorheological elastomer of the damper shown in FIG. 6 with a friction member added thereto. FIG. 11 is a transverse cross-sectional view of the damper coupled with the magnetorheological elastomer of FIG. 10. FIG. 12 is a longitudinal cross-sectional view of the damper coupled with the magnetorheological elastomer of FIG. 10.

In describing the embodiments shown in FIGS. 10 to 12, the same configurations as those shown in FIGS. 1 to 9 may be assigned the same reference numerals, and further descriptions may be omitted.

The damper 100 may include a friction member 600. The friction member 600 may be disposed between the piston 200 and the magnetorheological elastomer 500. In particular, the friction member 600 may be disposed in the through hole 503 of the magnetorheological elastomer 500. The friction member 600 may be in contact with the inner surface 502 of the cylindrical portion 510.

In response to a magnetic field being applied to the magnetorheological elastomer 500, the stiffness of the magnetorheological elastomer 500 may increase, which may increase the normal drag force acting on the friction member 600. As a result, the normal drag force exerted by the friction member 600 on the piston 200 may increase, and the frictional force between the friction member 600 and the piston 200 due to the up-and-down movement of the piston 200 may increase, thereby increasing the damping force of the damper 100.

The friction member 600 may extend along the circumference of the piston 200. The friction member 600 may have a cylindrical shape. The diameter of the friction member 600 may be set to be smaller than the diameter of the magnetorheological elastomer 500.

Although the friction member 600 is shown in the drawings as having a cylindrical shape corresponding to the shape of the magnetorheological elastomer 500, but the present disclosure is not limited thereto. For example, the friction member 600 may have a cylindrical shape with a recess, or may have a rib shape.

The length of the friction member 600 may correspond to the length of the magnetorheological elastomer 500.

The friction member 600 may be in contact with the piston 200. The addition of the friction member 600 may improve the durability of the damper 100. In particular, the friction member 600 may prevent the magnetorheological elastomer 500 from directly rubbing against the piston 200, thereby preventing wear of the magnetorheological elastomer 500. In addition, the friction member 600 may absorb noise generated by the friction of the piston 200, thereby reducing the noise of the damper 100.

The friction member 600 may include polyurethane. The magnetorheological elastomer 500 and the friction member 600 may be integrally formed.

While the present disclosure has been particularly described with reference to exemplary embodiments, it should be understood by those of skilled in the art that various changes in form and details may be made without departing from the spirit and scope of the present disclosure.

The invention claimed is:

1. A clothing treatment apparatus comprising:

a cabinet;

a tub to be disposed within the cabinet; and a damper configured to support the tub while the tub is disposed within the cabinet;

wherein the damper comprises:

a housing, a piston configured to be movable within the housing, a core, to be disposed within the housing, and including a yoke and teeth extending from the yoke toward the piston, a coil wound on the core, and a magnetorheological elastomer to be disposed between the piston and the core whereby while the magnetorheological elastomer is between the piston and the core, stiffness of the magnetorheological elastomer is changeable by a magnetic field applied to control a movement of the piston within the housing.

2. The clothing treatment apparatus of claim 1, wherein the teeth extend in a direction different from a direction in which the piston moves.

3. The clothing treatment apparatus of claim 1, wherein the teeth extend in a direction perpendicular to a direction in which the piston moves.

4. The clothing treatment apparatus of claim 1, wherein the coil is wound on the teeth in a direction perpendicular to a direction in which the piston moves.

5. The clothing treatment apparatus of claim 1, wherein the yoke has an annular shape, and the teeth are disposed radially between the yoke and the piston.

6. The clothing treatment apparatus of claim 1, wherein the teeth are first teeth and the core includes second teeth spaced apart from the first teeth along a circumferential direction of the yoke.

7. The clothing treatment apparatus of claim 6, wherein the coil is a first coil wound on the first teeth, and the damper comprises a second coil wound on the second teeth and spaced apart from the first coil along the circumferential direction of the yoke.

8. The clothing treatment apparatus of claim 6, wherein the magnetorheological elastomer comprises:

a cylindrical portion coupleable to the piston, and an insertion portion protruding from the cylindrical portion toward the housing and disposed between the first teeth and the second teeth.

9. The clothing treatment apparatus of claim 6, wherein the second teeth are arranged at a height that is same as a height of the first teeth.

10. The clothing treatment apparatus of claim 1, wherein the teeth comprise:

a winding portion on which the coil is wound, and a guide portion disposed at one end of the winding portion facing the magnetorheological elastomer, and having a plate shape.

11. The clothing treatment apparatus of claim 10, wherein the guide portion is formed to be curved corresponding to a circumference of the magnetorheological elastomer.

12. The clothing treatment apparatus of claim 1, further comprising a friction member disposed between the piston and the magnetorheological elastomer.

13. The clothing treatment apparatus of claim 12, wherein the friction member includes polyurethane.

14. The clothing treatment apparatus of claim 1, wherein the housing comprises:

an upper cap configured to cover an upper portion of the core, a lower cap configured to cover a lower portion of the core, and a guide ring disposed between the upper cap and the lower cap and surrounding the core.

15. The clothing treatment apparatus of claim 1, wherein the stiffness of the magnetorheological elastomer increases based on formation of the magnetic field.

* * * * *